US007208055B2

(12) United States Patent
Stratton et al.

(10) Patent No.: US 7,208,055 B2
(45) Date of Patent: Apr. 24, 2007

(54) THERMAL TREATMENT METHOD

(75) Inventors: Paul Francis Stratton, Bradley-Huddersfield (GB); John B. Boodey, Wrightstown, PA (US)

(73) Assignee: The BOC Group, plc, Windlesham, Surrey (GB)

( * ) Notice: Subject to any disclaimer, the term of this patent is extended or adjusted under 35 U.S.C. 154(b) by 0 days.

(21) Appl. No.: 10/521,526

(22) PCT Filed: Jul. 14, 2003

(86) PCT No.: PCT/GB03/03077

§ 371 (c)(1),
(2), (4) Date: Nov. 7, 2005

(87) PCT Pub. No.: WO2004/007788

PCT Pub. Date: Jan. 22, 2004

(65) Prior Publication Data

US 2006/0099435 A1 May 11, 2006

(30) Foreign Application Priority Data

Jul. 16, 2002 (GB) ..... 0216527.2

(51) Int. Cl.
*C23C 8/12* (2006.01)
*C22F 1/18* (2006.01)

(52) U.S. Cl. ..... 148/284; 148/281; 148/669; 148/672

(58) Field of Classification Search ..... 148/281, 148/284, 559, 668, 669, 672

See application file for complete search history.

(56) References Cited

U.S. PATENT DOCUMENTS

| | | | | |
|---|---|---|---|---|
| 4,263,060 A | | 4/1981 | Gaucher et al. | 148/6.3 |
| 5,051,140 A | * | 9/1991 | Mushiake et al. | 148/281 |
| 5,316,594 A | | 5/1994 | Kemp | 148/281 |

FOREIGN PATENT DOCUMENTS

| | | |
|---|---|---|
| EP | 0 388 710 B1 | 2/1994 |
| EP | 0 580 081 B1 | 3/1997 |
| JP | 03 036257 | 2/1991 |

(Continued)

OTHER PUBLICATIONS

Surface Hardening of Titanium by Oxygen; Transactions of the Japan Institute of Metals, Japan Institute of Metals, Sandai, JP vol.3, 1962; pp. 10-14, XP002080647 ISSN: 0021-4434 Figures 1-3 (no month).

Fatigue Properties of Zinc Single Crystals and Polycrystals, I. Fatigue Strength; Jiro Watanabe; Feb. 17, 1962.

(Continued)

*Primary Examiner*—Michael E. Lavilla
(74) *Attorney, Agent, or Firm*—Bernard Lau; Philip H. VonNeida

(57) ABSTRACT

An article of titanium or a titanium-based alloy, or of zirconium or a zirconium-based alloy is case hardened by heat treatment for at least 12 hours at one or more temperatures in the range of 850° C. to 900° C. and at a pressure in the order of atmospheric pressure in an oxygen diffusion atmosphere. The oxygen diffusion atmosphere comprises a carrier gas such as argon which does not react chemically with the article the said temperature range and molecular oxygen. The concentration of oxygen as the oxygen diffusion atmosphere is in the range of 10 volumes per million to 400 volumes per million.

6 Claims, 3 Drawing Sheets

FOREIGN PATENT DOCUMENTS

| | | |
|---|---|---|
| JP | 07 180025 | 7/1995 |
| WO | 96/23908 | 8/1996 |
| WO | 98/02595 | 1/1998 |
| WO | 99/04055 | 1/1999 |

OTHER PUBLICATIONS

PCT International Search Report; Oct. 15, 2003; EPO; Examiner G. Badcock.
PCT International Preliminary Examination Report; May 13, 2004.

* cited by examiner

THERMAL TREATMENT METHOD

This invention relates to a thermal treatment method. In particular, it relates to a method of case hardening an article of titanium or zirconium or of an alloy based on titanium or zirconium.

WO-A-96/23908 discloses a process for manufacturing a titanium article with a hardened surface for enhanced wear resistance comprising the steps of exposing the article to an oxygen-containing environment; heating the article to a temperature that allows oxygen to diffuse into the article; soaking the article at the temperature for a time sufficient to oxidise elemental metal at the surface and cooling the article to room temperature. The heating and soaking take place at about 500° C., and the oxygen-containing environment is an atmosphere of air.

U.S. Pat. No. 5,316,594 relates to forming a hardened outer shell on a refractory workpiece using an argon-oxygen atmosphere containing from 1 to 3 mole percent of oxygen. If the workpiece is of zirconium the maximum treatment temperature is 1400° F. (760° C.). If the workpiece is of titanium the maximum treatment temperature is 815° C.

EP-A-580,081 relates to the treatment of intermetallic compounds of titanium and aluminium in an atmosphere containing 20% by volume of oxygen.

U.S. Pat. No. 4,263,060 relates to the treatment of titanium articles with oxygen at a sub-atmospheric pressure.

WO-A-99/04055 (The University of Birmingham) discusses the need to provide engineering alloys of titanium or zirconium with a hard case consisting of a region of relatively high hardness maintained to a certain depth below the surface before dropping more steeply and then gradually to the hardness of the untreated core material. WO-A-99/04055 discloses a method of case hardening an article formed of titanium, zirconium or an alloy of titanium and/or zirconium in which the article is heat treated for a short period of time, typically from 0.3 to 0.6 hour, in an oxidising atmosphere containing both oxygen and nitrogen (typically air) at a temperature in the range of 700 to 1000° C. so as to form an oxide layer on the article, and then further heat treating the article in a vacuum or in a neutral or an inert atmosphere at a temperature in the range of 700 to 1000° C. so as to cause oxygen from the oxide layer to diffuse into the article.

According to WO-A-99-04055 the case hardened article may then be surface treated by the method according to WO-A-98/02595 (The University of Birmingham) so as to improve the tribological behaviour of the article. This surface treatment comprises gaseous oxidation of the article at a temperature in the range of 500 to 725° C. for 0.1 to 100 hours, the temperature and time being selected such as to produce an adherent surface component layer containing at least 50% by weight of oxides of titanium having a rutile structure and a thickness of 0.2 to 2 μm on a solid solution-strengthened diffusion zone wherein the diffusing element is oxygen and the diffusion zone has a depth of 5 to 50 μm.

The dual step oxidation/diffusion treatment of the method according to WO-A-99/04055 is difficult to control. A small variation in the amount of oxide formed in the first oxidation step can result in a significant difference in the eventual hardness profile at the end of the diffusion time in the vacuum or the neutral or inert atmosphere. The method therefore relies entirely on empirical control, thereby causing difficulties if it is required to treat a range of articles of different shapes and sizes.

According to the present invention there is provided a method of case hardening an article of titanium or a titanium-based alloy, or of zirconium or a zirconium-based alloy, wherein the article is heat treated at one or more temperatures in the range of 850° C. to 900° C. and at a pressure in the order of atmospheric pressure in an oxygen diffusion atmosphere comprising (a) a carrier gas which does not react chemically with the article in the said temperature range and (b) molecular oxygen, wherein the concentration of oxygen in the oxygen diffusion atmosphere is in the range of 10 volumes per million to 400 volumes per million.

In the method according to the invention the rate of oxygen diffusion from the surface into the body of the article is a function of the oxygen potential, i.e. the partial pressure of oxidant in the oxygen diffusion atmosphere. The measurement in real time of the oxygen partial pressure of a heat treatment atmosphere is conventional in some heat treatments of ferrous workpieces and may be performed using commercially available instrumentation. Accordingly control of the oxygen potential is a simple matter of appropriately selecting the mole fraction of oxidant molecules in the oxygen diffusion atmosphere and, if necessary, adjusting the mole fraction in response to a real time oxygen potential measurement.

The carrier gas is preferably a noble gas such as helium, xenon, neon or argon, or a mixture of one or more such noble gases. Argon is particularly preferred. It should be noted that nitrogen reacts with titanium and zirconium at temperatures in the heat treatment range and therefore cannot be included in the carrier gas.

The method according to the invention is performed at a pressure that is approximately the same as the prevailing atmospheric pressure, i.e. at a pressure in the range of 1.0 to 1.2 bar.

Preferably the oxygen concentration is in the range of 75 to 300 volumes per million; more preferably the oxygen concentration is in the range of 100 to 200 volumes per million. These oxygen concentrations are preferred for the following reasons. At below about 75 parts by volume per million, the rate of oxygen diffusion is undesirably low and therefore the time required to complete the treatment is undesirably high. At 500 parts by volume of oxygen and above there is too marked a surface oxidation which can inhibit diffusion of oxygen atoms into the article being treated and/or a spalled surface oxide is produced, a condition considered unacceptable for engineering components. Indeed, at oxygen concentrations of 5000 parts by volume per minute an impermeable oxide surface is rapidly formed. It is within the scope of the invention, however, to increase the concentration and/or partial pressure of oxygen in the atmosphere at or near the end of the treatment so as to form a visible surface oxide layer that improves the tribological properties of the article. Such formation of a surface oxide layer can be performed at the same temperature as the diffusion or at a lower temperature, i.e. at any temperature in the range 500 to 900° C. and employing an atmosphere having an oxygen concentration of at least 5000 volumes per million.

The method according to the present invention is particularly useful in case hardening engineering components or other articles formed of commercially pure grades of titanium, of titanium-based alloys ($\alpha$, $\alpha+\beta$, or $\beta$ alloys), of commercially pure grades of zirconium, and of zirconium-based alloys.

When the article is required to have enhanced fatigue properties, it may be subjected after heat treatment to a mechanical surface treatment, such as shot peening.

The method according to the present invention will now be further described with reference to the following Examples and to the accompanying drawings, in which.

EXAMPLES

Figure 1:
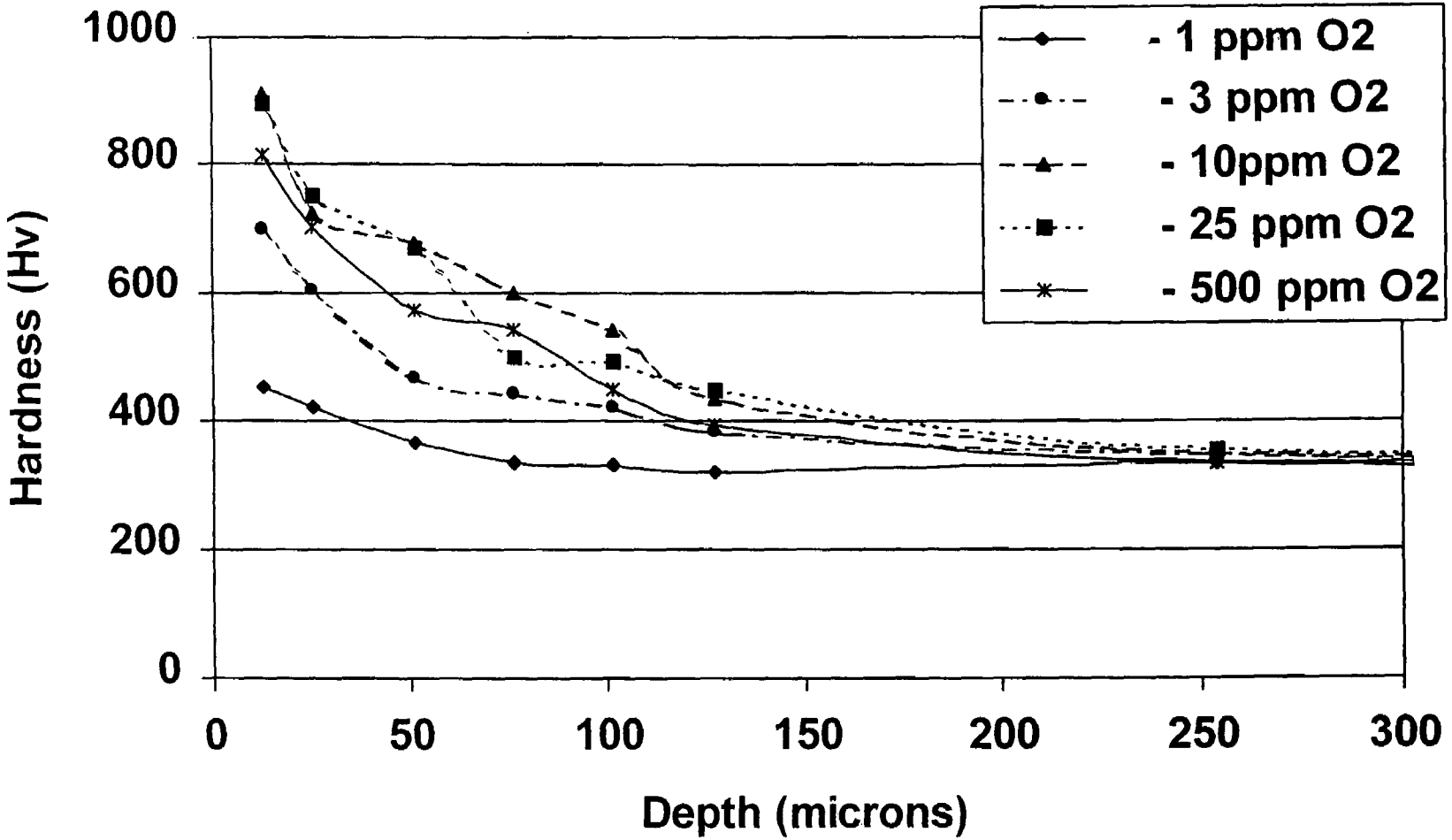
FIG. 1 is a graph showing the Vickers hardness profile for samples of titanium alloy treated at 850° C.

Materials—Ti-6Al-4V alloy was selected as the test material as this alloy constitutes some 50–60% of the global titanium output. Samples of Grade 5 Ti-6Al-4V (25 mm×50 mm×3.2 mm) were acquired with a 600 grit surface finish. The chemical composition of the alloy is shown in Table 1. Prior to treatment each specimen was cleaned with 2% Alconox™ aqueous detergent in an ultrasonic bath followed by an ethanol rinse and warm air dry. The specimens were weighed to an accuracy of ±0.01 mg after cleaning.

TABLE 1

Chemical Composition of the Grade 5Ti—6Al—4V Alloy

| | Element | | | | | | | | |
|---|---|---|---|---|---|---|---|---|---|
| | Al | V | C | Fe | N | O | H | Y | Ti |
| at % (by weight) | 6.15 | 3.93 | 0.03 | 0.15 | 0.02 | 0.17 | 47 ppm | <50 ppm | Bal. |

Test Apparatus—All of the thermal treatments were conducted in a high purity alumina tube furnace at a temperature of either 850° C. or 900° C. During processing the atmosphere was maintained at a constant inlet composition and flow of 3000 cc/mm using a MLKS 647B Multi-Channel Gas Controller system. Two argon/oxygen mixtures were mixed to produce the correct atmosphere composition. The first mixture was "house" argon with less than 1 ppm oxygen. The second mixture was obtained from a certified premixed cylinder containing argon with 1040 ppm oxygen. The temperature was maintained with an external thermocouple and monitored with an internal thermocouple. Two samples were heat treated together and were held vertically in a specially manufactured holder to ensure uniform surface exposure. At the outlet side of the tube furnace, an Illinois Instruments oxygen analyser, Model 2550 was used to monitor the composition of the flowing gas.

Procedure—After weighing, two samples were inserted into the centre of tube furnace in the specimen holder. Prior to heating the tube furnace and samples were purged with house argon for 1 hour to obtain a background level of less than 1 ppm residual oxygen in the system. This atmosphere was used during heating to 850° C. or 900° C. After the target temperature was attained, the inlet gas composition was changed to the test atmosphere. Samples were treated in atmospheres containing oxygen in the range 1 to 500 ppm for 24 hours at temperature. After the 24 hour period the atmosphere was returned to 100% house argon and maintained during furnace cooling to room temperature. In two cases, the atmosphere composition was further modified to a second oxygen level during the heat treatment period. These two tests were conducted for a total of 28 hours, 20 hours at the first oxygen level and 8 hours at the second. As a baseline, samples were treated in argon containing less than 1 ppm oxygen for 24 hours. After the samples were removed from the furnace, each was again weighed to an accuracy of ±0.01 mg.

Hardness and Microstructural Evaluation—The maximum surface hardness and depth of penetration were measured using a Vickers hardness traverse at 25 and 50 gram loads. The lower load was used primarily at the edge of the sample to eliminate the risk of cracking. Microstructural features, such as case depth, were observed by light microscopy after etching in Kroll's etchant (2% hydrofluoric acid in water).

X-Ray Diffractometry—After the heat treatment was completed, the surface oxide layer of one of the samples from some select treatments was evaluated. A Philips X'Pert PRO Multi-Purpose Diffractometer operating at 40 kV and 50 mA was used. The 2-theta scan was from 20 to 100 degrees at a step size of 0.01 degree and a rate of 0.4 sec/step. The resultant data was analysed using Philip's Analytical X'Pert Software to identify the observed peaks.

Results

Figure 2:
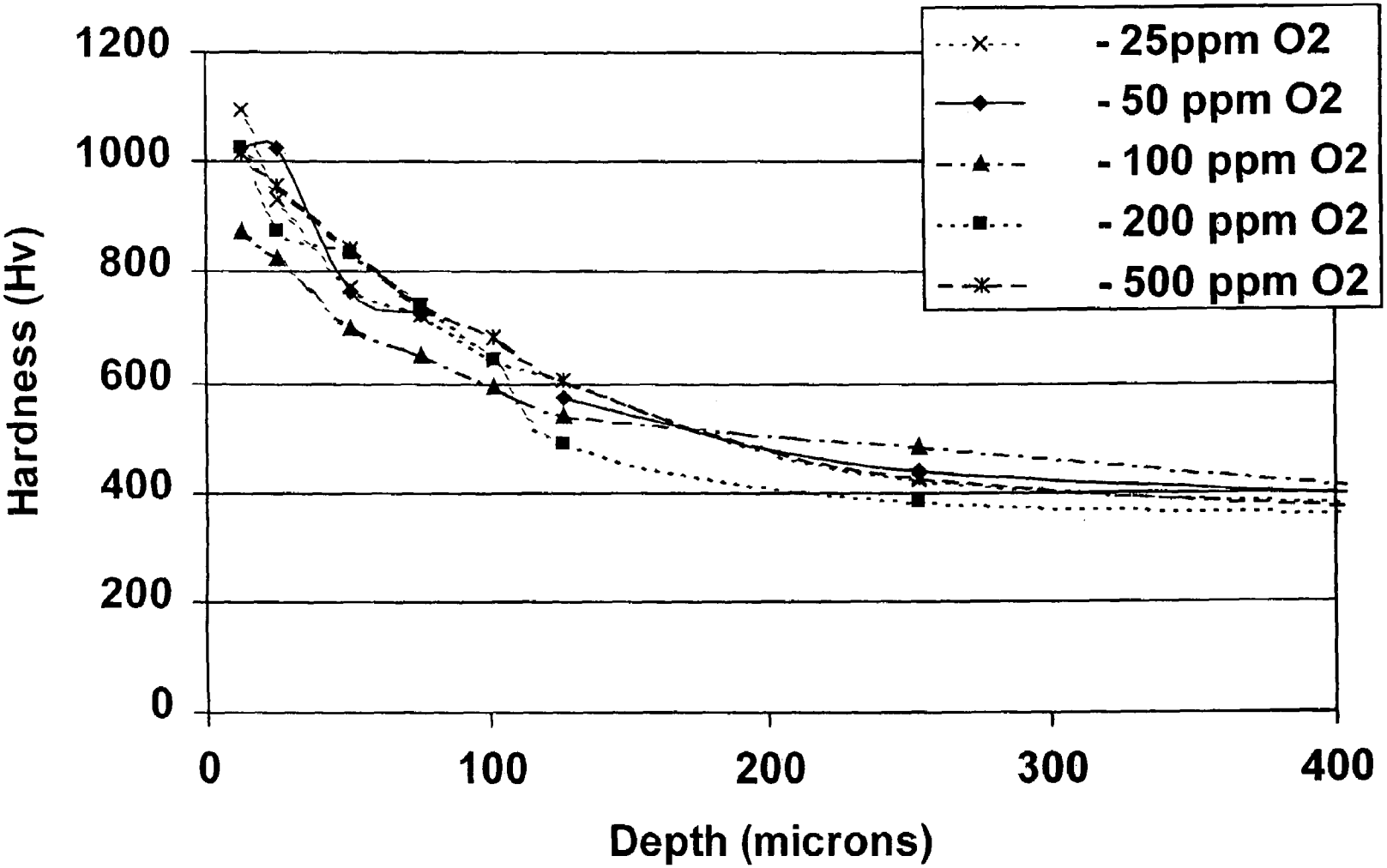
FIG. 2 is a similar graph to FIG. 1 but showing the Vickers hardness profile for samples treated at 900° C.

The hardness profile of specimens heat treated at 850° C. and 900° C. in various oxygen concentrations are shown in FIGS. 1 and 2. The difference in the magnitude of hardening between the two heat treatment temperatures is obvious. The 900° C. treatments produced a much higher surface hardness and resulted in a greater depth of penetration for an equivalent exposure time, as would have been expected from Fick's Law.

Figure 3:
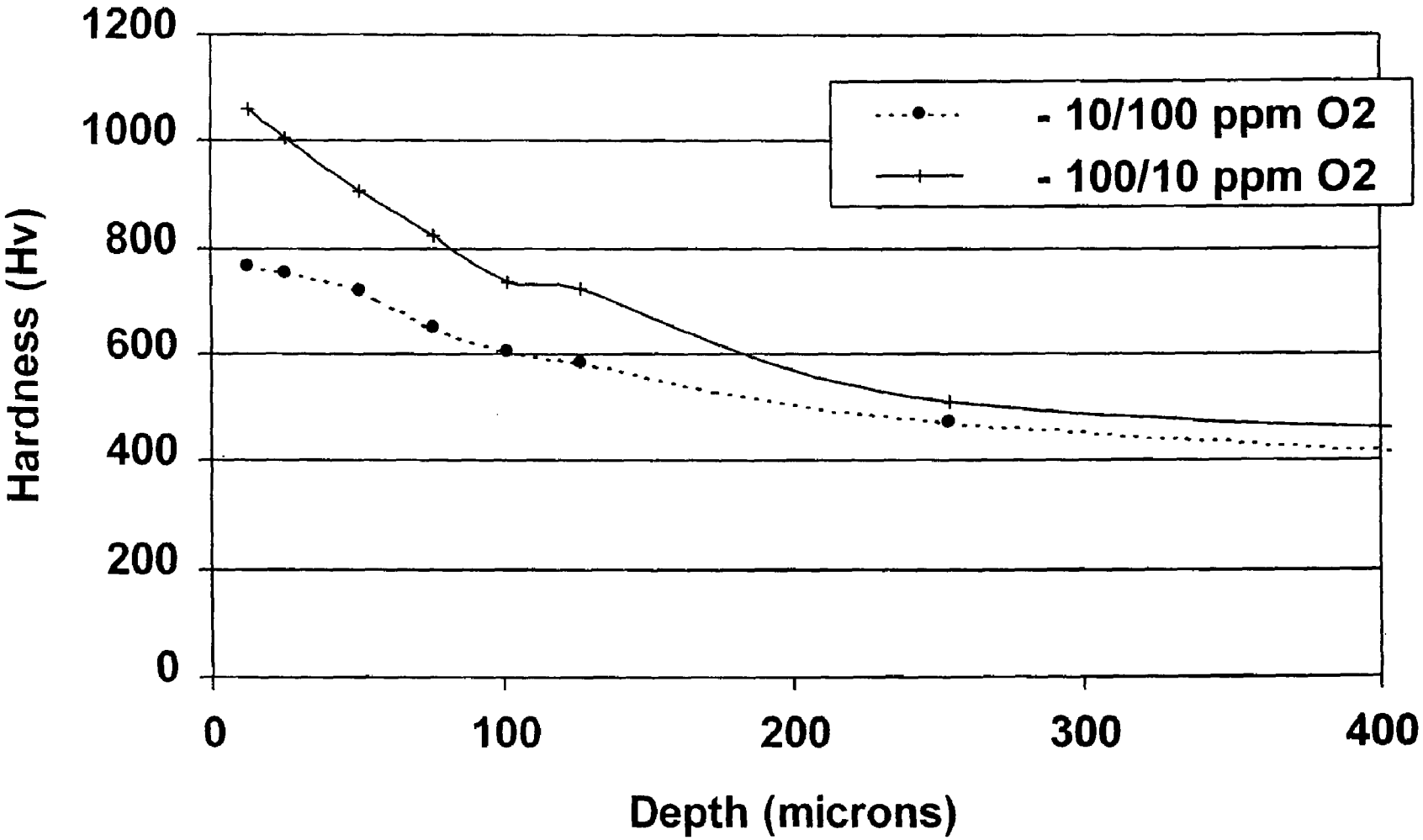
FIG. 3 is a similar graph to FIG. 1 but showing the effect of treatment at two different temperatures.

The baseline treatment of 1 ppm of oxygen at 850° C. resulted in a very minor hardness increase at the surface and the depth of penetration was less than 75 microns. FIG. 3 shows the hardened alpha case for this specimen. In addition to the lack of significant hardening, only a slight surface scale was present. The average total weight gain for the two specimens treated at this condition was only 0.35 milligrams.

Increasing the partial pressure of oxygen from 1 ppm to 3, 10 and 25 ppm significantly changed the maximum surface hardness and depth of penetration. An incremental increase is clearly observed from 1 to 3 ppm and again from 3 to 10 ppm of oxygen in FIG. 1. At 25 ppm oxygen no significant change in the hardness profile was measured, but the depth of the alpha case is greater in comparison with the 10 ppm sample. The total average eight gain for the three conditions of 3, 10 and 25 ppm were 2.96 mg, 8.29 mg, and 18.44 mg respectively. The weight gain corresponded directly to the degree of surface oxidation and the depth of penetration observed.

The highest oxygen concentration in argon used (500 ppm) resulted in a heavy oxidation layer in addition to the surface hardening. On removal from the furnace a good portion of the oxide scale spalled off of the specimens. This significant oxide coating appears to have reduced the amount of oxygen penetration by acting as a diffusion barrier. In both the hardness profile (FIG. 1), the depth of penetration is clearly less than that observed for both the 10 and 25 ppm conditions. This combination of surface condition and hardness profile was not considered useful.

None of the samples heat treated at 850° C. had either the maximum case depth or the hardness profile required for maximum performance.

The heat treatments conducted at 900° C. produced an improvement in the depth of penetration and the formation of the appropriate surface oxide. Five oxygen concentrations were evaluated at this temperature. The hardness profiles obtained for oxygen concentrations of 25, 50, 100, 200 and 500 ppm are shown in FIG. 2. It can be seen that, for these conditions, the depth of penetration was in excess of 250 microns. The maximum hardness obtained was in excess of 1000 Hv for some of the conditions.

It was found important not to let the temperature exceed 900° C.; otherwise undesirable internal oxidation occurred. The samples treated at 900° C. with 100 and 200 ppm of oxygen clearly showed the depth of hardening was twice that observed for the 850° C. heat treatments. The surface layer was essentially 100% alpha slowly changing to the alpha-beta microstructure as the depth increases.

The heat treatment at 500 ppm again produced a spalled surface oxide, a condition considered unacceptable for an engineering component. The 100 and 200 ppm surfaces were fairly uniform and adherent and no spalling occurred after removal from the furnace. The weight gains for the 900° C. treatments were significantly greater than those observed for the 850° C. treatments. The average gains were 21.7 mg at 25 ppm; 58.1 mg at 50 ppm; 68.4 mg at 100 ppm; and 85.0 mg at 200 ppm. Based solely on the surface films produced and the depth of penetration this increase in weight was within the expected range.

Two double treatments were conducted to evaluate the effect of a more oxidising condition (100 ppm oxygen) in combination with a less oxidising condition (10 ppm oxygen). In a first treatment the sample was subjected at 900° C. to 10 ppm oxygen for 20 hours, and then to 100 ppm oxygen for a further 8 hours. In a second treatment, the sample was subjected to 100 ppm oxygen for 20 hours and then to 10 ppm oxygen for a further 8 hours. Each of these treatments thus had a total exposure time of 28 hours compared with the 24 hours for the single treatments. The 10 ppm followed by 100 ppm condition produced a more uniform depth of penetration with a consistent hardness over the first 75 microns. The surface oxide was found to be adherent and uniform with a weight gain that was measured to be 37.5 mg.

The second double treatment of 100 ppm followed by 10 ppm produced an extremely hard surface and an enhanced depth of penetration. It is believed that the lower partial pressure reduced some of the scale formed during the initial 100 ppm exposure and allowed for further oxygen penetration. This treatment produced the greatest depth of hardening. The average weight gain for these two samples was 62.1 mg, a value slightly less than that observed for the single 24 hour 100 ppm treatment (68.4 mg).

X-ray diffraction data revealed that some treatments did result in rutile, $TiO_2$, on the surface of the specimens. The single treatments at 900° C. of 100 ppm and 200 ppm oxygen resulted in a rutile scale on top of the alpha case. The treatment at 850° C. and 10 ppm, which resulted in only a visible surface haze, did not exhibit any discernible surface oxides. However, examination of this sample showed that the alpha peaks were shifted due to the interstitial oxygen in the hexagonal close packed lattice. This shift made identifying the alpha peaks in other samples easier.

Two of the double treatment specimens were examined and found to have very little rutile oxide on their surfaces. One specimen, 20 hours at 10 ppm and 8 hours at 100 ppm, visually appeared to be the same as the single treatment 100 ppm specimen but only small amount of rutile was detected. Other oxides, $Ti_2O_3$ and $Ti_9O_{17}$ were more predominant. This result indicated that 8 hours at 100 ppm oxygen is not enough to form a uniform rutile scale. Another specimen, 20 hours at 100 ppm and 8 hours at 10 ppm, did not exhibit any rutile scale at all. The scale was a mixture of non-protective titanium oxides. Clearly the reduced 10 ppm oxygen level eliminated the surface rutile oxide that was present after treatment at 100 ppm. Visually this specimen appeared to have a different scale, a light grey colour compared to a dark blue-grey colour on the other samples. Although this treatment produced the greatest depth of penetration, the surface scale was not ideal for engineering applications.

The single 900° C. treatments at oxygen concentrations of 100 ppm and 200 ppm oxygen resulted in a rutile surface after 24 hours of exposure. The double treatment that ended with 8 hours at 100 ppm only formed a small amount of rutile indicating that extended times are required to obtain the equilibrium oxide of rutile. Based upon the x-ray analyses, the two double treatments, although producing an excellent alpha-case, are not effective in forming duplex surfaces. It is believed that by modifying the atmosphere to the oxygen composition of air (i.e. from 75 to 85% by volume argon; 15 to 25% by volume oxygen) for the last 20 minutes of treatment at 850° C. would produce a rutile layer of optimum thickness over the alpha case produced at 900° C.

The invention claimed is:

1. A method of case hardening an article of titanium or a titanium-based alloy, or an article or zirconium or a zirconium-based alloy, comprising treating the article with heat for a period of at least 12 hours at at least one temperature selected from the range of 850° C. to 900° C. and at a pressure on the order of atmospheric pressure in an oxygen diffusion atmosphere, the atmosphere comprising:

a) a carrier gas which does not react chemically with the article in the temperature range, and b) molecular oxygen, wherein a concentration of oxygen in the oxygen diffusion atmosphere is in the range of 10 volumes per million to 400 volumes per million.

2. The method according to claim 1, wherein the oxygen concentration is in the range of 75 to 300 volumes per million.

3. The method according to claim 2, wherein the oxygen concentration is in the range of 100 to 200 volumes per million.

4. The method according to claim 2, further comprising subjecting the article to further heat treatment at a temperature in the range of 500° C. to 900° C.in an atmosphere having an oxygen concentration of at least 5000 volumes per million, with the balance being non-reactive carrier gas so as to form a visible surface oxide layer on the article to improve tribiological properties of the article.

5. The method accordingly to claim 4, wherein the atmosphere in which the tribiological surface oxide layer is formed contains from 15% to 25% by volume of oxygen and from 75% to 85% by volume of argon.

6. The method accordingly to claim 4, wherein the carrier gas is argon.

* * * * *